US007268649B2

(12) United States Patent
Lee

(10) Patent No.: US 7,268,649 B2
(45) Date of Patent: Sep. 11, 2007

(54) PARTIAL SUSPENDED OPEN-LINE RESONATOR FOR PARALLEL COUPLED LINE FILTERS

(75) Inventor: Sheng-Yuan Lee, Taipei Hsien (TW)

(73) Assignee: VIA Technologies, Inc., Taipei (TW)

( * ) Notice: Subject to any disclaimer, the term of this patent is extended or adjusted under 35 U.S.C. 154(b) by 0 days.

(21) Appl. No.: 11/622,820

(22) Filed: Jan. 12, 2007

(65) Prior Publication Data

US 2007/0109077 A1 May 17, 2007

Related U.S. Application Data

(63) Continuation-in-part of application No. 11/036,110, filed on Jan. 14, 2005.

(51) Int. Cl.
*H01P 1/203* (2006.01)

(52) U.S. Cl. ..... 333/204; 333/219

(58) Field of Classification Search ..... 333/204, 333/205, 34, 238, 246
See application file for complete search history.

(56) References Cited

U.S. PATENT DOCUMENTS

2005/0083148 A1* 4/2005 Hsu ..... 333/33
2005/0237126 A1* 10/2005 Babb et al. ..... 333/34

* cited by examiner

*Primary Examiner*—Stephen E. Jones
(74) *Attorney, Agent, or Firm*—J.P. Patents

(57) ABSTRACT

The present invention disclosed a partial-suspended open-line resonator for parallel-coupled line filter for size shrinking and well resonant response. The partial-suspended open-line resonator comprises one open conductive line, one etched ground structure having a lattice adjacent to the conductive line, wherein the lattice is formed on a ground plane. Furthermore, a part of the conductive line is suspended over the lattice.

11 Claims, 7 Drawing Sheets

PARTIAL SUSPENDED OPEN-LINE RESONATOR FOR PARALLEL COUPLED LINE FILTERS

CROSS-REFERENCE TO RELATED APPLICATION

This application is a continuation-in-part of a prior application Ser. No. 11/036,110, filed Jan. 14, 2005. All disclosure of the U.S. application is incorporated herein by reference.

BACKGROUND OF THE INVENTION

The present invention is related to RF circuit design, particularly to a partial-suspended open-line resonator for parallel-coupled line filter system.

Planar filters are particularly desired in the RF front-end of modern communication systems because of the easier fabrication and lower cost. One type of planar filter is the parallel-coupled line filter composed of a series of half-wavelength resonant conductive lines. Furthermore, the resonators are parallel-coupled and span the distance about a quarter of one wavelength.

FIG. 1 shows a top view of a conventional parallel-coupled line filter 10. For example, the filter 10 exhibiting a third-order filter response at 2 GHz comprises three open line resonators 11. The conventional parallel-coupled line resonators 11 are commonly used in relative applications due to their simple circuit structure. The structure of the open-line resonator 11 comprises an open conductive line without via connections to a ground plane and reduces the complexity of the circuit. However, the dimension of the conventional parallel-coupled line filter 10 can be rather large because the length of the resonator 11 is approximate to half of the wavelength at the fundamental mode.

The hairpin resonator is proposed to reduce the circuit size by folding the conventional open-line resonator. But it suffers the problem in the spurious responses occurred around the harmonics of the fundamental mode, especially for oscillator and amplifier applications.

The stepped impedance resonator is another approach to shrink the circuit size and adjust the frequency of spurious mode. The stepped impedance resonator utilizes alternating high impedance and low impedance transmission line sections rather than primarily reactive components. The conventional stepped impedance resonator is composed of the conductive lines of different width connected in series. Hence the stepped impedance resonator is easy to design and typically shorter than other types of resonator. However, the conductor loss of the resonator is increased as the total conductor area enlarged for different impedance. Moreover, the impedance ratio between high impedance and low impedance is limited because of the restriction on the line width in the fabrication.

Thus, it is desirable for a resonator to provide the advantages of easy design, simple structure and well resonant response.

SUMMARY OF THE INVENTION

In view of the foregoing, the present invention provides a partial-suspended open-line resonator for parallel-coupled line filter.

The present invention is directed to a partial-suspended open-line resonator comprising: a ground plane having only one etched ground structure; and an open conductive line adjacent to the ground plane, the open conductive line having only one suspended part on the etched ground structure, a first non-suspended part and a second non-suspended part, wherein the suspended part has a first end connected to the first non-suspended part and a second end connected to the second non-suspended part, and wherein half of an electrical length of the suspended part is $\theta 1$, an electrical length of at least one of the first and second non-suspended parts is $\theta 2$, and the electrical length ratio ($\theta 2/\theta 1$) is 1~3.

The present invention is also directed to a parallel-coupled line filter system comprising: a ground plane having a plurality of etched ground structures; and a plurality of open-line resonators adjacent to the ground plane, each of the open-line resonators having only one suspended part, a first non-suspended part and a second non-suspended part, wherein for each of the open-line resonators, the suspended part has a first end connected to the first non-suspended part and a second end connected to the second non-suspended part, and the suspended part is located on a respective one of the etched ground structures.

The objects and aspects of the present invention will become apparent from the following descriptions of the embodiments with reference to the accompanying drawings, which is set forth hereinafter.

DESCRIPTION OF THE EMBODIMENTS

The present invention provides a partial-suspended open-line resonator for the parallel-coupled line filter for size-shrinking and excellent behavior in the spurious response.

Figure 2:
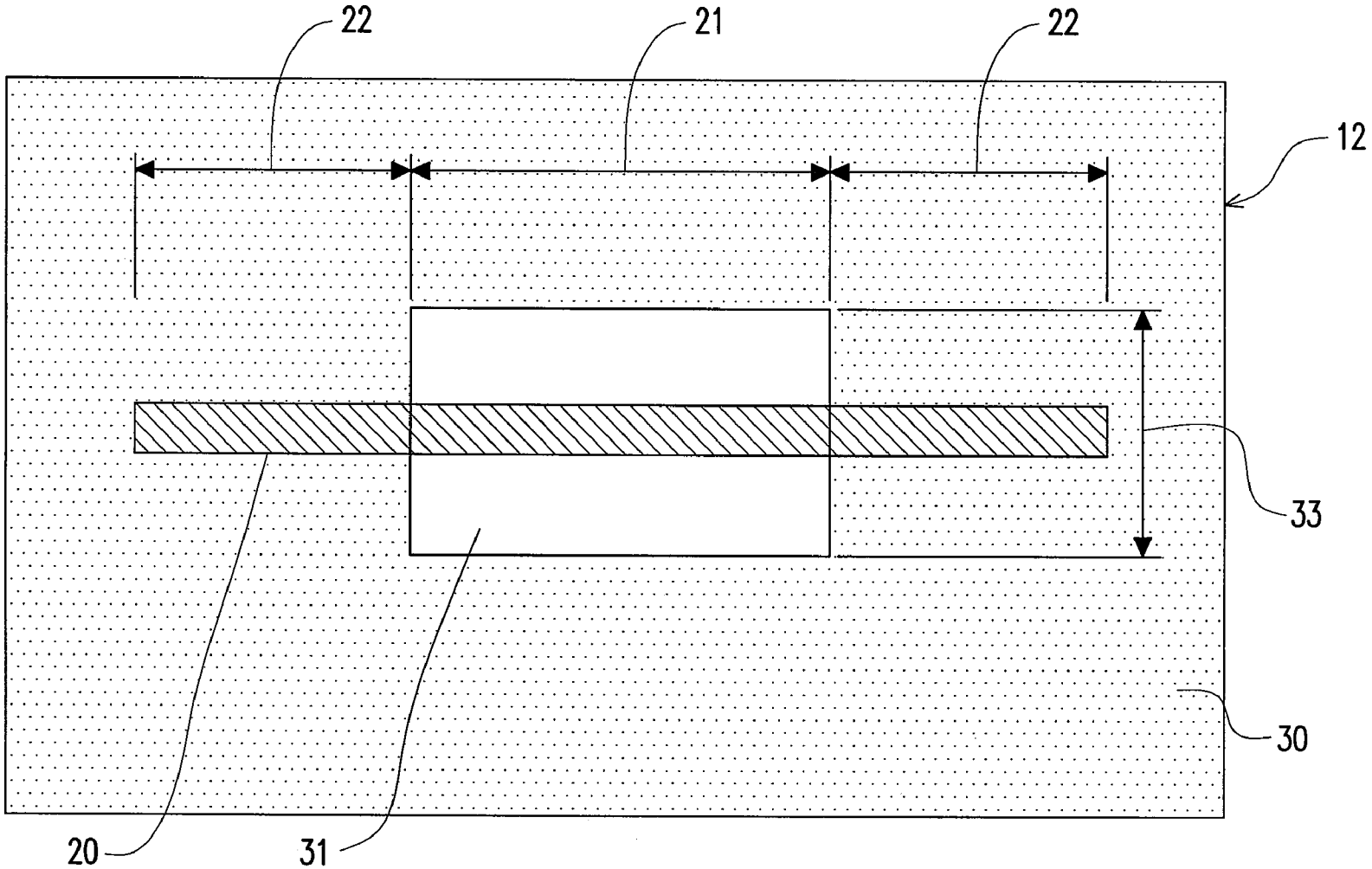
FIG. 2 illustrates a top view of a partial-suspended open-line resonator according to the present invention.

FIG. 2 shows a top view of a partial-suspended open-line resonator 12 according to the present invention. The preferred embodiment comprises an open conductive line 20, a ground plane 30 having an etched ground structure 31 adjacent to the center of the conductive line. The etched ground structure 31 is rectangular or square, which of the width 33. The etched ground structure 31 is disposed at the position downwardly projected on the center of the conductive line 20, thus the partial-suspended open-line resonator is symmetric to the center point and is divided into three parts: a suspended part 21 over the etched ground structure 31 and two non-suspended parts 22 connected to both ends of the suspended part 21. The length of the suspended part 31, the length of the non-suspended part 32 and the width 33 are the major characteristics of the partial-suspended open-line resonator 12 and are illustrated in the following descriptions.

Figure 3:
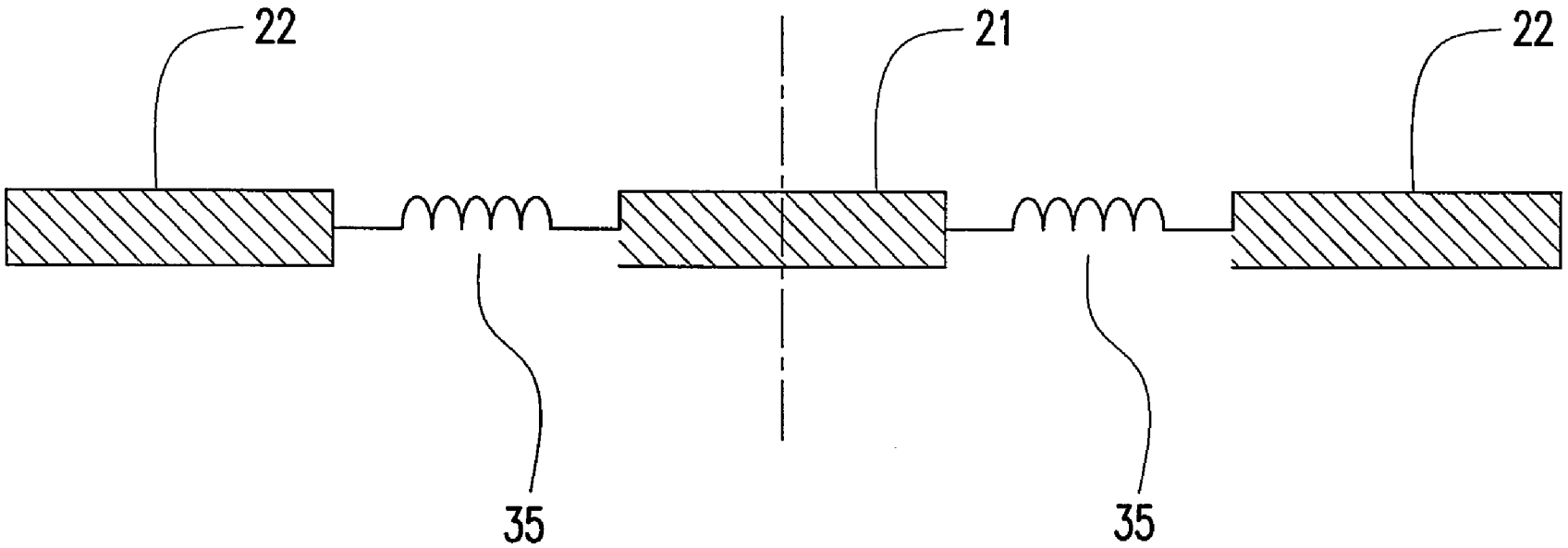
FIG. 3 illustrates an equivalent circuit of a partial-suspended open-line resonator according to the present invention.

FIG. 3 shows the equivalent circuit of the embodiment corresponding to FIG. 2. Because the etched ground structure 31 results in the discontinuity on the ground plane 30, the return current respect to the signal trace is detoured on the ground plane 30. The etched ground structure 31 is equivalent as a serious inductor 35 connected between a suspended part 21 and a non-suspended part 22. The value of the equivalent inductor 35 is direct proportional to the width 33 of the etched ground structure 31.

For the investigation of the resonator conditions, even and odd mode analysis is one the most common techniques to analyze such a circuit. Since the partial-suspended open-line resonator 12 is symmetric, only half of the equivalent circuit needs to be analyzed. When the partial-suspended open-line resonators are operated at odd mode, i.e. operated at the fundamental mode, the center of the resonator is "virtual short to ground". The resonant condition for the simplified circuit at the fundamental mode can be found:

$$X_{L_fo}+Z_1 \tan\theta_1=Z_2 \cot\theta_2 \quad (1)$$

where $X_{L_fo}=\omega L_{fo}$, is the reactance of the series inductor 35 at the fundamental mode. The $Z_1$ is presented the impedance of the suspended part 21 and determined by the width of the open-line resonator and the width of the etched ground 33. Similarly, the impedance $Z_2$ of the non-suspended part 22 is determined by the width of the open-line resonator. $\theta_1$ is half of the electrical length of the suspended part 21 in the conductive line 20, and $\theta_2$ is the electrical length of the non-suspended part 22 in the conductive line 20. The value of $\theta_1$ and $\theta_2$ are related to the practical length of suspended part 21 and non-suspended part 22. For the better stopband bandwidth, the electrical length ratio ($\theta_2/\theta_1$) may be chosen from 1~3.

Similarly, when the resonators are operated at even mode, i.e. at the first spurious mode, the center is equivalent to an open circuit. The resonant condition of the simplified circuit at the first spurious mode can be found:

$$X_{L_fs}-Z_1 \cot\theta_1=Z_2 \cot\theta_2 \quad (2)$$

where $X_{L_fs}=\omega L_{fs}$, is the reactance of the series inductor 35 at the first spurious mode.

Similarly, the conventional resonant conditions for stepped impedance resonators are known as:

$$Z_1 \tan \theta_1=Z_2 \cot \theta_2 \quad (3)$$

$$Z_1 \cot \theta_1=-Z_2 \cot \theta_2 \quad (4)$$

wherein, the formula (3) is presented the resonator operated at the fundamental mode and the formula (4) is presented the resonator operated at the first spurious mode.

Comparing to the above-mentioned four formulas of the resonant conditions, the difference between the stepped impedance resonator and the partial-suspended open-line resonator is the reactance $X_L$ of the series inductor 35. Therefore, the resonant conditions of the present embodiment are similar to those of the stepped impedance resonator if neglecting the effect of the discontinuities on the ground plane 30.

Since the return current of the partial-suspended open-line resonator encounters a large discontinuity between the etched and the solid ground planes, the resulted inductance should have certain influences on the resonant conditions. Because the electrical length $2\theta_1$, $\theta_2$ and the reactance $X_L$ of the equivalent inductor 35 are all related to the resonant frequencies of the fundamental and the first spurious mode, it is hard to completely analyze the relation between the resonant behaviors and all circuit parameters. However, the main resonant behavior of the open-line resonator could be determined if assuming the reactance $X_L$ as a fixed value to simplify the complex circuit.

Figure 4A:
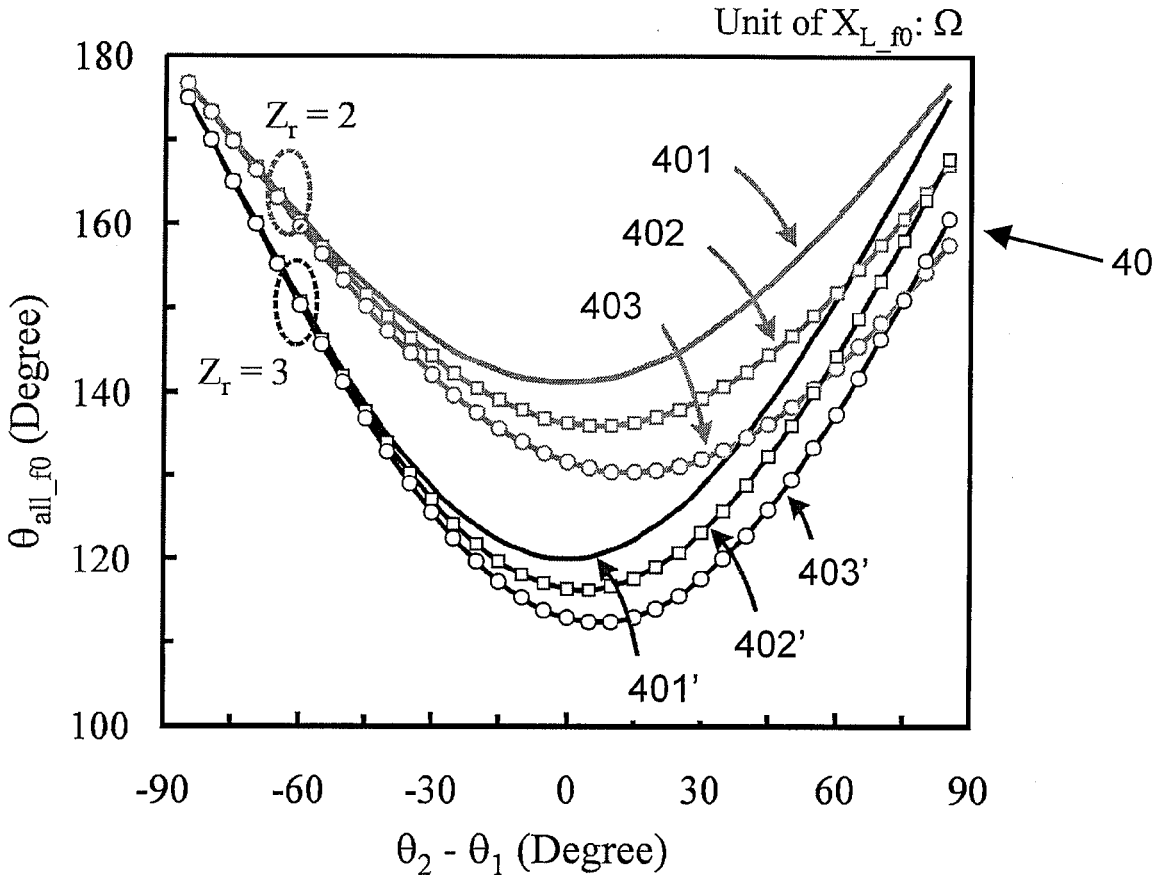
FIG. 4A illustrates a main characteristic graph of the embodiments operated at the fundamental mode by a simple equivalent circuit analysis.

FIG. 4A shows the resonant behavior when the resonator operated at the fundamental mode, where the total electrical length of the open-line resonator is $\theta_{all_fo}=2(\theta_1+\theta_2)$ and the reactance of the equivalent inductor 35 is $X_{L_fo}$. The embodiment A, B and C are the respective resonators with equivalent inductor 35 of 0, 0.5 and 1 nH for the fundamental frequency at 2 GHz when the impedance ratio $Z_r$ ($Z_r=Z_1/Z_2$) is equal to 2. The curve 401, 402 and 403 respectively present the resonant behavior of the embodiment A, B and C. Similarly, the curve 401', 402' and 403' respectively present the resonant behavior of other embodiment A', B' and C' with the corresponding inductor 35 of 0, 0.5 and 1 nH when the impedance ratio $Z_r$ is 3. For the embodiment A and A', the zero equivalent inductor 35 means to ignore the discontinuity of the ground plane 30. As above-mentioned, the embodiment A and A' also present the resonant behavior of the conventional stepped impedance resonator. It is obvious that the total electrical length $\theta_{all_fo}$ is smaller as the impedance ratio $Z_r$ increasing. This means that the fundamental mode is at a lower frequency if the practical length of the resonator is fixed. Moreover, as the series conductor 35 is larger, the resonant frequency of the fundamental mode is lower for the same impedance ratio $Z_r$. Therefore, in order to maintain the desired frequency of fundamental mode, the partial suspended open-line resonator should be shorter than the conventional stepped impedance resonator. On the other hand, the minimum of the total electrical length is at the lowest point of each curve. For the conventional stepped impedance resonator, the minimum electrical length is occurred when $\theta_1=\theta_2$. However, the minimum electrical length for the partial-suspended open-line resonator is shifted to the condition that $\theta_2$ is slightly larger than $2\theta_1$ because of the inductive discontinuity.

Figure 4B:
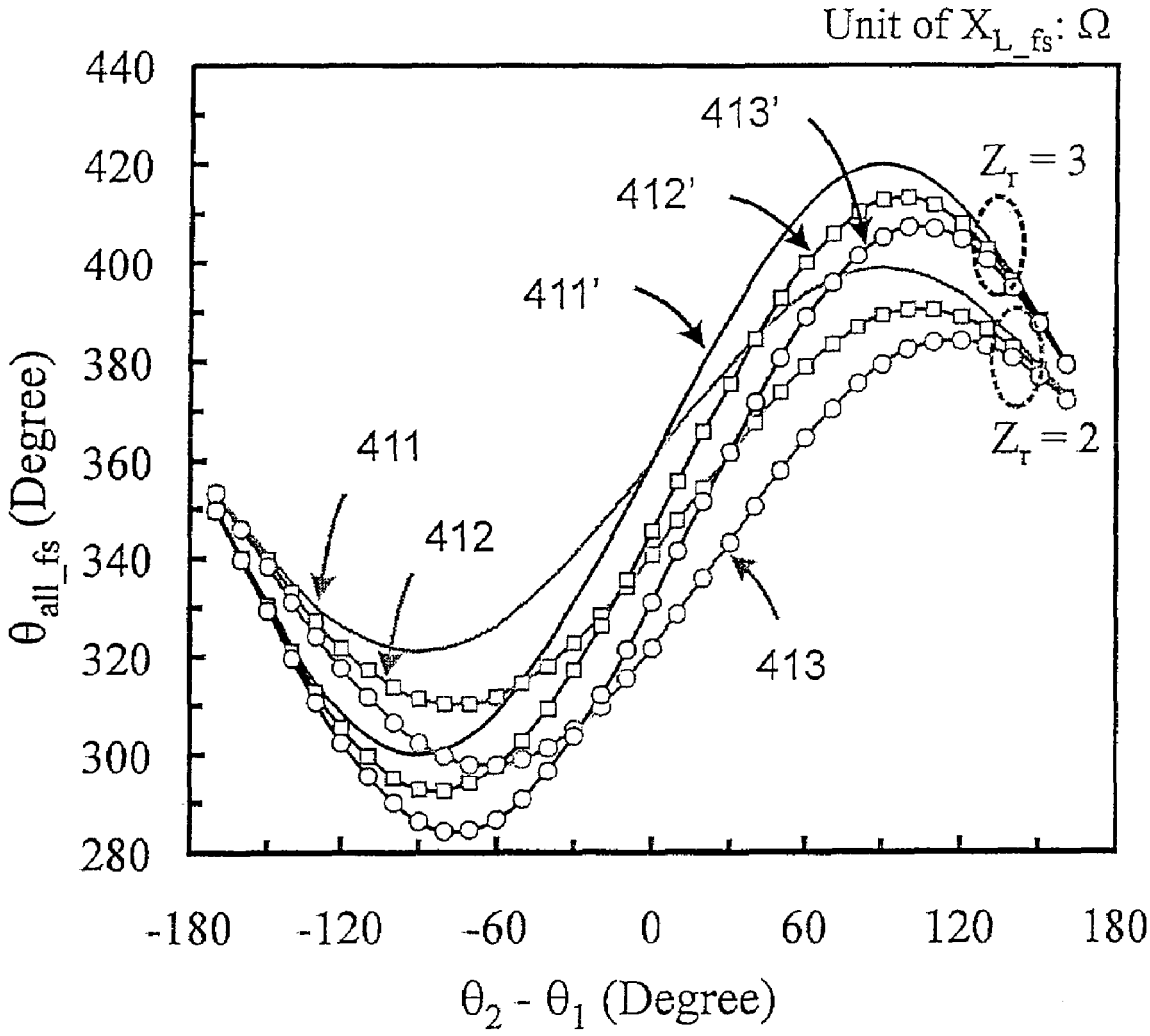
FIG. 4B illustrates a main characteristic graph of the embodiments operated at the first spurious mode by a simple equivalent circuit analysis.

Similarly, FIG. 4B shows the resonant behavior at the first spurious mode. The curve 411, 412, and 413 respectively presents the resonant behavior of the embodiment A, B and C and the curve 411', 412', and 413' respectively presents the corresponding resonator A', B' and C'. If the length of the resonator is kept the same, the first spurious modes are also lower by the inductance from the discontinuity on the ground plane 30.

According to the even and odd analysis in above-mentioned descriptions, both the resonant frequencies of the fundamental and the first spurious modes are lower by the inductance from the discontinuity on the ground plane if the open-line resonator has the same length. As the result, the frequency ratio of the fundamental and the first spurious mode is almost kept the same. In other word, the partial-suspended open-line resonator for the same fundamental frequency has a shorter length and shifts the spurious resonance to higher frequencies.

Figure 1:
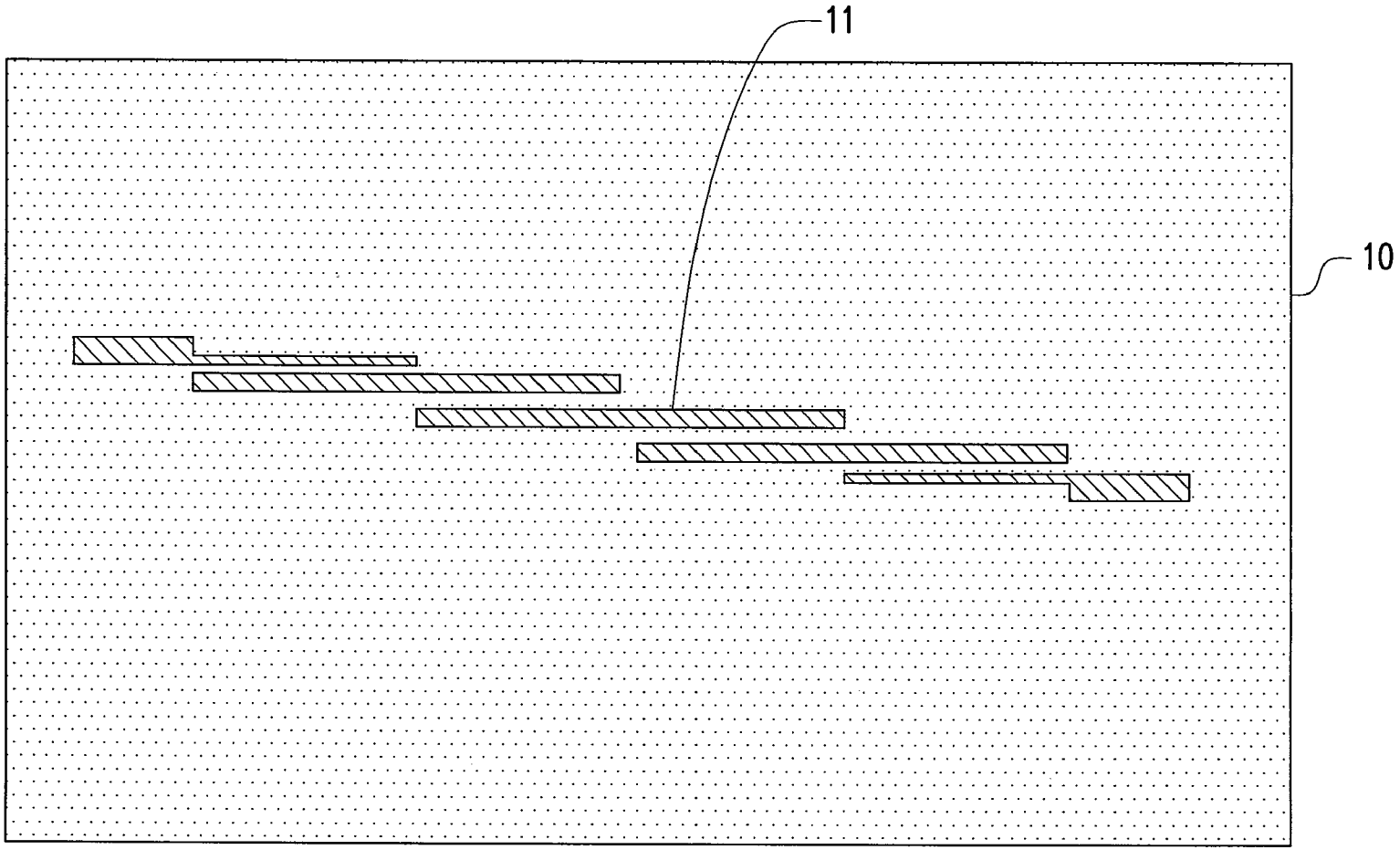
FIG. 1 (PRIOR ART)
FIG. 1 illustrates a top view of a conventional parallel-coupled line filter.
Figure 5:
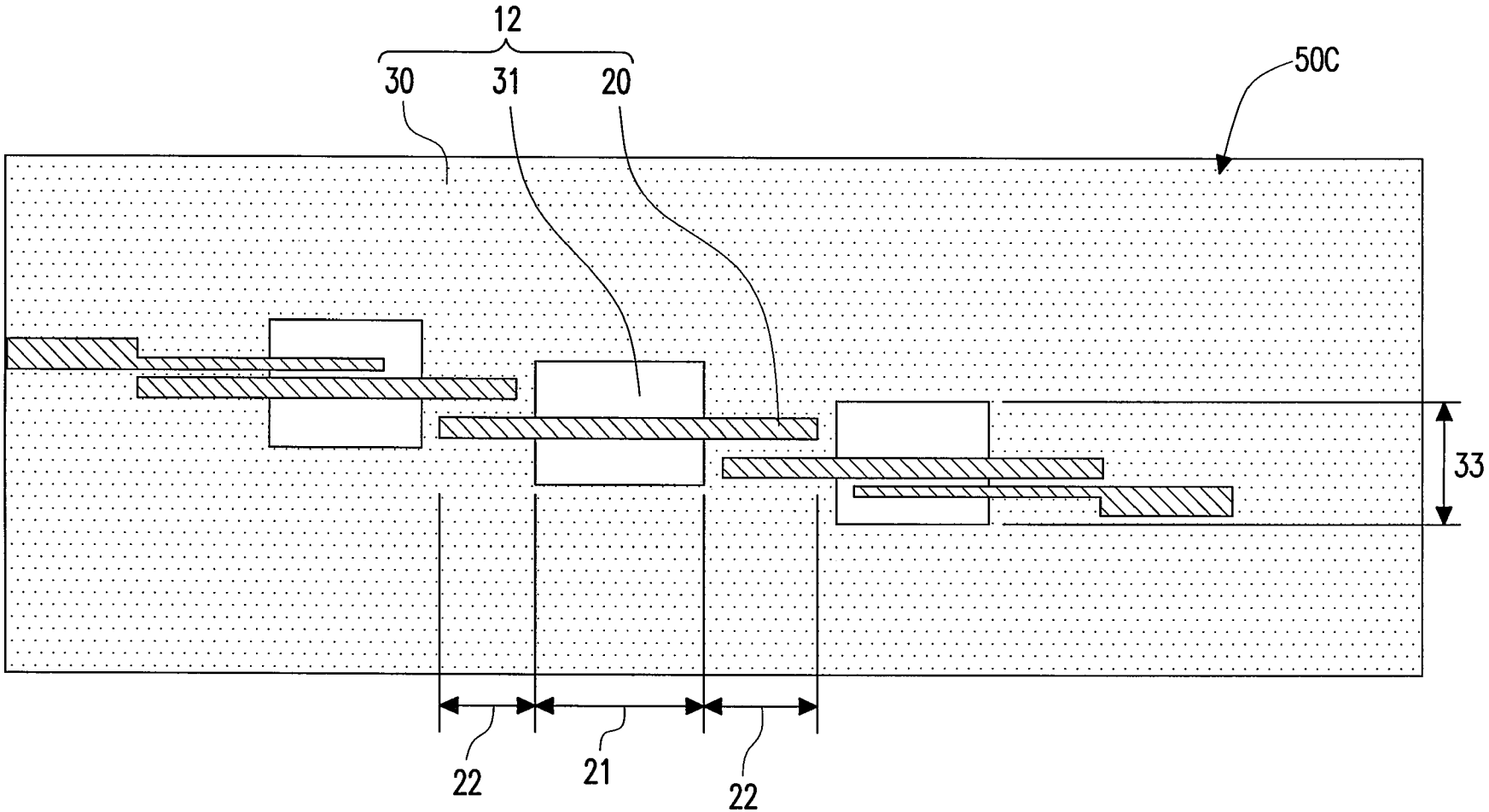
FIG. 5 illustrates a top view of a filter with partial-suspended open-line resonator according to the present invention.
Figure 6:
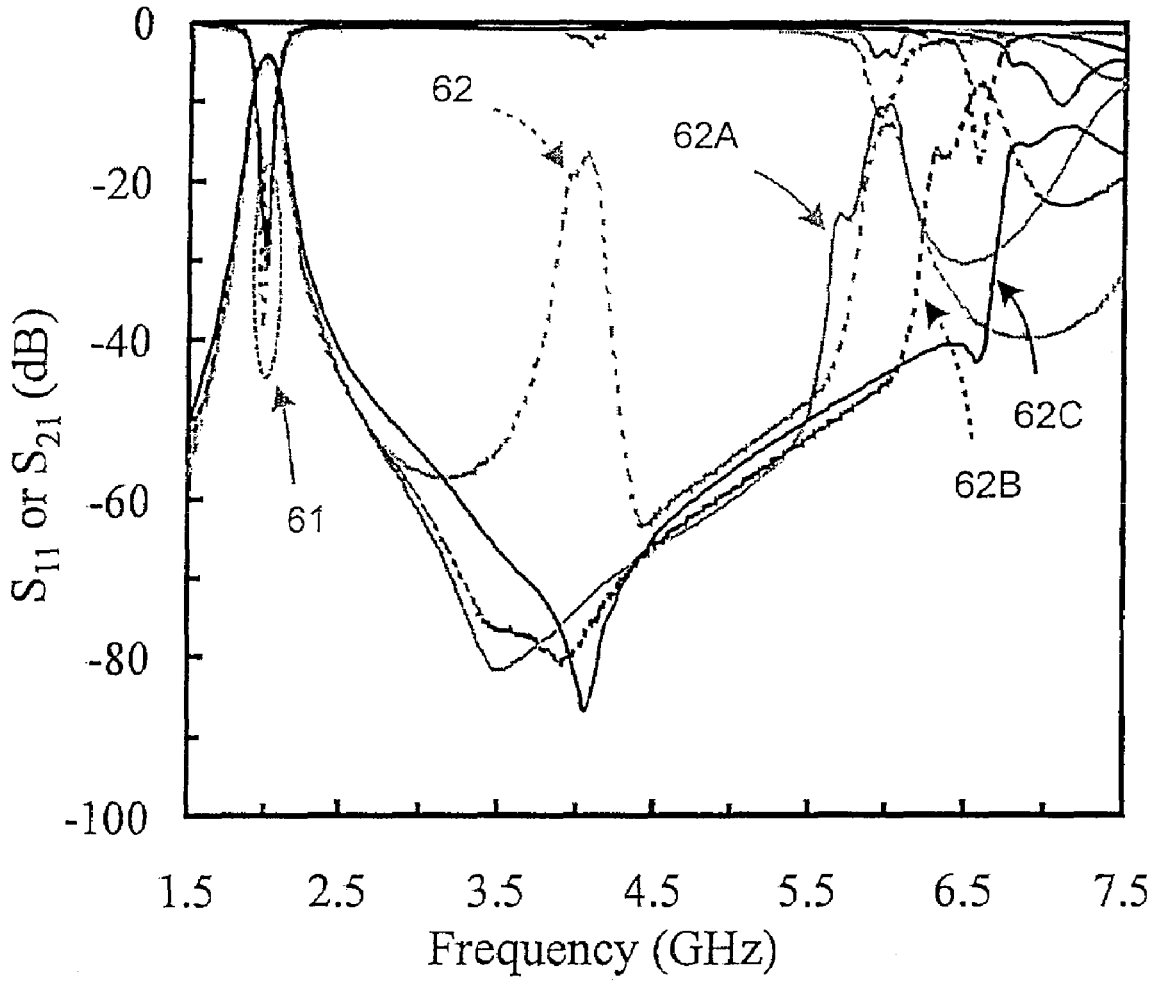
FIG. 6 illustrates a graph comparing the frequency responses of different parallel-coupled line filters.

According to the conventional parallel-coupled open-line filter 10 shown in FIG. 1, three parallel-coupled line filter 50A, 50B and 50C with partial-suspended open-line resonator 12 are disclosed, wherein the widths 33 of the etched ground structure 31 in the embodiment 50A, 50B and 50C are respective 200 mil, 300 mil and 400 mil. For example, FIG. 5 shows a top view of the embodiment 50C according to the present invention. The total length of the parallel-coupled line filter 50C is only 87% comparing to the conventional one with the same fundamental frequency because of the partial-suspended open-line resonators. FIG. 6 shows the responses of the conventional parallel-coupled open-line filter 10, the embodiment 50A, 50B and 50C. According to those response curves, the fundament frequencies 61 of all filters are at 2 GHz as the design consideration. The first spurious frequency 62 of the conventional parallel-coupled open-line filter 10 is around 4 GHz, twice of the fundamental frequency. However, the first spurious frequency 62A of filter 50A is shifted to 5.7 GHz. Furthermore, the first spurious frequency 62B and 62C of filter 50B and 50C are shifted to higher frequencies. As the result, a wide spurious-free stopband is created and the spurious response is avoided happening at the harmonics of the fundamental mode.

In sum, comparing to the prior arts, the partial-suspended open-line resonator and the parallel-coupled filter with it have at least following advantages: (1) a short length and simple structure, thus the manufacturing cost is lower; (2) the spurious resonance frequency is shifted higher to avoid the harmonics of the fundamental mode and to increase the reliability of the circuit; (3) a simple design method to determine the characteristics of the partial-suspended open-line resonators.

Although the invention is illustrated and described herein as embodied in one or more specific examples, it is nevertheless not intended to be limited to the details shown, since various modifications and structural changes may be mode therein without departing from the spirit of the invention and within the scope and claims be constructed broadly and in a manner consistent with the scope of the invention, as set forth in the following claims.

What is claimed is:

1. A partial-suspended open-line resonator comprising:

a ground plane having only one etched ground structure; and an open conductive line adjacent to the ground plane, the open conductive line having only one suspended part on the etched ground structure, a first non-suspended part and a second non-suspended part, wherein the suspended part has a first end connected to the first non-suspended part and a second end connected to the second non-suspended part, and wherein half of an electrical length of the suspended part is θ1, an electrical length of at least one of the first and second non-suspended parts is θ2, and the electrical length ratio (θ2/θ1) is 1~3.

2. The resonator of claim 1, wherein the etched ground structure is of a rectangular shape.

3. The resonator of claim 1, wherein the etched ground structure is of a square shape.

4. The resonator of claim 1, wherein the resonator is symmetric to a center of the resonator.

5. The resonator of claim 1, wherein the resonator is operated at a fundamental frequency of 1 GHz or above.

6. The resonator of claim 1, wherein the width of the etched ground structure is proportional to an equivalent inductor of the etched ground structure.

7. A parallel-coupled line filter system comprising:

a ground plane having a plurality of etched ground structures; and a plurality of open-line resonators adjacent to the ground plane, each of the open-line resonators having only one suspended part, a first non-suspended part and a second non-suspended part, wherein for each of the open-line resonators, the suspended part has a first end connected to the first non-suspended part and a second end connected to the second non-suspended part, and the suspended part is located on a respective one of the etched ground structures.

8. The filter system of claim 7, wherein each of the etched ground structures is of a rectangular shape.

9. The filter system of claim 7, wherein each of the etched ground structures is of a square shape.

10. The filter system of claim 7, wherein the filter system is operated at a fundamental frequency of 1 GHz or above.

11. The filter system of claim 7, wherein for each of the open-line resonators, half of an electrical length of the suspended part is θ1, an electrical length of at least one of the first and second non-suspended parts is θ2, and the electrical length ratio (θ2/θ1) is 1~3.

* * * * *